US007654541B2

(12) United States Patent
Stengel et al.

(10) Patent No.: US 7,654,541 B2
(45) Date of Patent: Feb. 2, 2010

(54) CART FOR DISCRETELY SECURELY TRANSPORTING AUDIOVISUAL AND OTHER EQUIPMENT

(75) Inventors: Michael John Stengel, Town and City, MO (US); Trung Q. Do, Bridgeton, MO (US)

(73) Assignee: Swank Audio Visuals, LLC, St. Louis, MO (US)

( * ) Notice: Subject to any disclaimer, the term of this patent is extended or adjusted under 35 U.S.C. 154(b) by 157 days.

(21) Appl. No.: 11/949,504

(22) Filed: Dec. 3, 2007

(65) Prior Publication Data

US 2008/0129003 A1 Jun. 5, 2008

Related U.S. Application Data

(60) Provisional application No. 60/868,243, filed on Dec. 1, 2006.

(51) Int. Cl.
*B62B 1/00* (2006.01)

(52) U.S. Cl. ..... 280/47.19; 280/47.35; 280/79.3; 280/651

(58) Field of Classification Search ..... 280/47.19, 280/47.34, 47.17, 47.28, 79.11, 651, 649, 280/659; 312/351.11, 9.1, 23, 209, 280; 211/90.61, 74, 149, 194, 151, 169, 201, 206
See application file for complete search history.

(56) References Cited

U.S. PATENT DOCUMENTS 2,557,262 A * 6/1951 Cordes ..... 211/191
3,787,072 A * 1/1974 DeBoer et al. ..... 280/79.11
4,998,023 A * 3/1991 Kitts ..... 280/47.35
5,016,765 A * 5/1991 Leonardo ..... 211/189
5,056,672 A * 10/1991 Yamada ..... 211/149
5,370,245 A * 12/1994 Tersch et al. ..... 211/74
5,716,116 A * 2/1998 Carlson et al. ..... 312/280
6,079,719 A * 6/2000 Tisbo et al. ..... 280/47.35
6,102,497 A * 8/2000 Ehr et al. ..... 312/209
6,669,213 B2 * 12/2003 Woerner ..... 280/47.35
6,732,662 B2 * 5/2004 Welch et al. ..... 211/126.15
6,767,019 B2 * 7/2004 van Hekken ..... 280/47.35

* cited by examiner

*Primary Examiner*—Hau V Phan
(74) *Attorney, Agent, or Firm*—Howard B. Rockman

(57) ABSTRACT

A cart for securing an transporting audiovisual equipment comprises two pairs of leg assemblies wherein each leg assembly is parallel and faces the other leg assembly. Each pair of legs further comprises individual legs secured to one another. Each leg has a bottom end, a top end, and an outer wall. In one embodiment, at least one of the legs has a hollow channel extending through at least on hollow leg. The hollow leg also comprises at least one aperture extending through the outer wall of the leg and communicating with the hollow channel. A top shelf is removably mounted at the top end of the legs and may also comprise at least one aperture near a corner of the shelf which communicates with the channel in the hollow leg. In an embodiment, the cart further comprises a utility shelf having a first and second portion, each portion pivotally connected to a connecting member at the bottom end of the legs and having a first open position and a second closed position to provide a flat lower storage space in the second closed position.

20 Claims, 17 Drawing Sheets

CART FOR DISCRETELY SECURELY TRANSPORTING AUDIOVISUAL AND OTHER EQUIPMENT

CROSS REFERENCE TO RELATED APPLICATIONS

This application claims priority from provisional application No. 60/868,243 filed on Dec. 1, 2006 to the extent allowed by law.

FIELD OF THE INVENTION

The invention is directed to a utility cart of the type commonly used in a conference or meeting venue, an office or other workspace type environment, and in particular to a mobile cart for storing and transporting electronic units such as television sets, projectors, computers, media players and the like.

BACKGROUND OF THE INVENTION

A common utility cart used for media displays at conferences, seminars and meetings includes a frame having a plurality of open shelves and casters mounted on a lower portion of the frame to facilitate the rolling movement of the cart along a floor surface. The shelves may be used to support electronic devices such as television sets, projectors, media players, and computers, for example, as well as to store and transport other related items such as connecting wires and other electronic accessories.

Such carts are simple in design and inexpensive. However, an aesthetic design and a convenient functionality or ease of use are important considerations for a user/consumer. It is desirable, for example to have a location within the cart to conceal electrical wires and power cables leading to electrical and electronic equipment, while making the wires and cables available for connection. Additionally, it is desirable that the cart provide additional storage space with a moveable shelf that can be hidden behind the legs of the cart when in the closed position for better sight lines in the cart's design. It is also desirable for a manufacturer to have a mounting system for easier shipping and assembly of the cart.

For the foregoing reasons, there is a need for an aesthetic, low cost, easy to use utility cart.

SUMMARY OF THE INVENTION

The present invention is directed to a cart for discretely securing and transporting audiovisual equipment or the like. The cart provides space to conceal electrical wires or other equipment, and sufficient storage space to allow a user to transport more equipment than with conventional carts. In one embodiment of the present invention, at least one of the legs of the cart has a hollow center or channel through the entire length of the leg and at least one aperture through the outer wall of the leg, the aperture communicating with the channel. The channel of the hollow leg provides a user with a place to conceal electrical wires or cables when those wires are connected to the electric or electronic equipment supported by the cart.

The cart further includes a top shelf mounted on and removably attached to the legs at the top end of the legs, and at least one aperture near a corner of the shelf. The aperture communicates with the hollow leg to allow a user to feed wires or cables into the hollow leg, and thereby conceal electrical wires or other equipment supported by the top shelf while using the cart. In one embodiment of the present invention, the top shelf also includes fixed or slidable hook structures mounted to the outer edge of the top shelf that allow other equipment, such as an easel, to be removably attached to the cart for storage or transportation.

In an embodiment, a pair of utility shelves are pivotally mounted near the bottom end of the legs of the cart. In a closed position, the vertical extent of each shelf is parallel to and hidden by an adjacent respective leg to provide a clean aesthetic sight line when a user views the cart. In the closed position, the shelves communicate with each other to provide a flat storage space at the bottom of the cart. The utility shelves are opened at the discretion of the user and will close under force of gravity.

A middle shelf is removably mounted to the legs between the top shelf and the utility shelves in an embodiment of the present invention. The middle shelf also includes at least one aperture extending through the shelf to communicate with the hollow leg. The hollow leg also includes an aperture located just below the middle shelf mounting structure to provide communication between the aperture in the middle shelf and the hollow leg.

An embodiment of the invention further includes a mounting assembly which provides for easy disassembly, shipping and assembly of the cart.

Another or second embodiment of the present invention has a shorter overall height dimension relative to the prior embodiment, but the majority of the structures and features are similar to that of the prior embodiment. In the second embodiment of the present invention, at least one of the legs has a hollow channel extending through the entire length of the leg, and at least one aperture through the outer wall of the leg communicating with the channel. The channel allows a user to extend and conceal electrical wires, cables or other equipment when those wires are connected to the electric or electronic equipment supported by the cart.

The cart of the second embodiment also includes a top shelf removably mounted to the legs at the top end of the legs, the top shelf having at least one aperture near a corner of the shelf. The aperture communicates with the top of the hollow leg to allow a user to hide electrical wires, cables or other equipment while using the cart.

A pair of utility shelves are pivotally mounted near the bottom end of the legs of the second embodiment of the cart. The shelf elements each have a vertical and horizontal component. Each portion of the utility shelf has a first open position and a second closed position. In the closed position, the vertical component of the utility shelf is parallel to and hidden by an adjacent leg to provide a clean aesthetic sight line when a user views the cart. The horizontal components in the closed position communicate with each other to provide a flat storage space in the cart while resting on a lower bracket connected to the horizontal support members. The utility shelves are opened at the discretion of the user and will close under force of gravity.

The second embodiment further includes a mounting assembly which provides for easier disassembly, shipping and assembly of the cart.

A third embodiment of the present invention includes a majority of the structural and functional features similar to the first embodiment. In this embodiment, certain features of the first or second embodiments are omitted to provide a less expensive audio visual equipment cart.

In another embodiment of the cart, all of the legs of the cart are hollow and contain a material, such as polyurethane foam or the like, to minimize or dampen noise and vibration throughout the cart. The material may be heat activated such that the material can be installed during manufacture of the easel and expand when a coating is baked on the legs of the cart. The material may be located in the form of blocks throughout the legs of the cart.

DETAILED DESCRIPTION OF THE ILLUSTRATED EMBODIMENT

The present invention is directed to a cart for discretely mounting, securing and transporting audiovisual equipment or other equipment as desired by the user. The cart has an aesthetic as well as a convenient and easy to use design. The cart also provides space to conceal electrical wires or other equipment, and additional storage space to allow a user to transport more equipment than with conventional carts.

Figure 1:
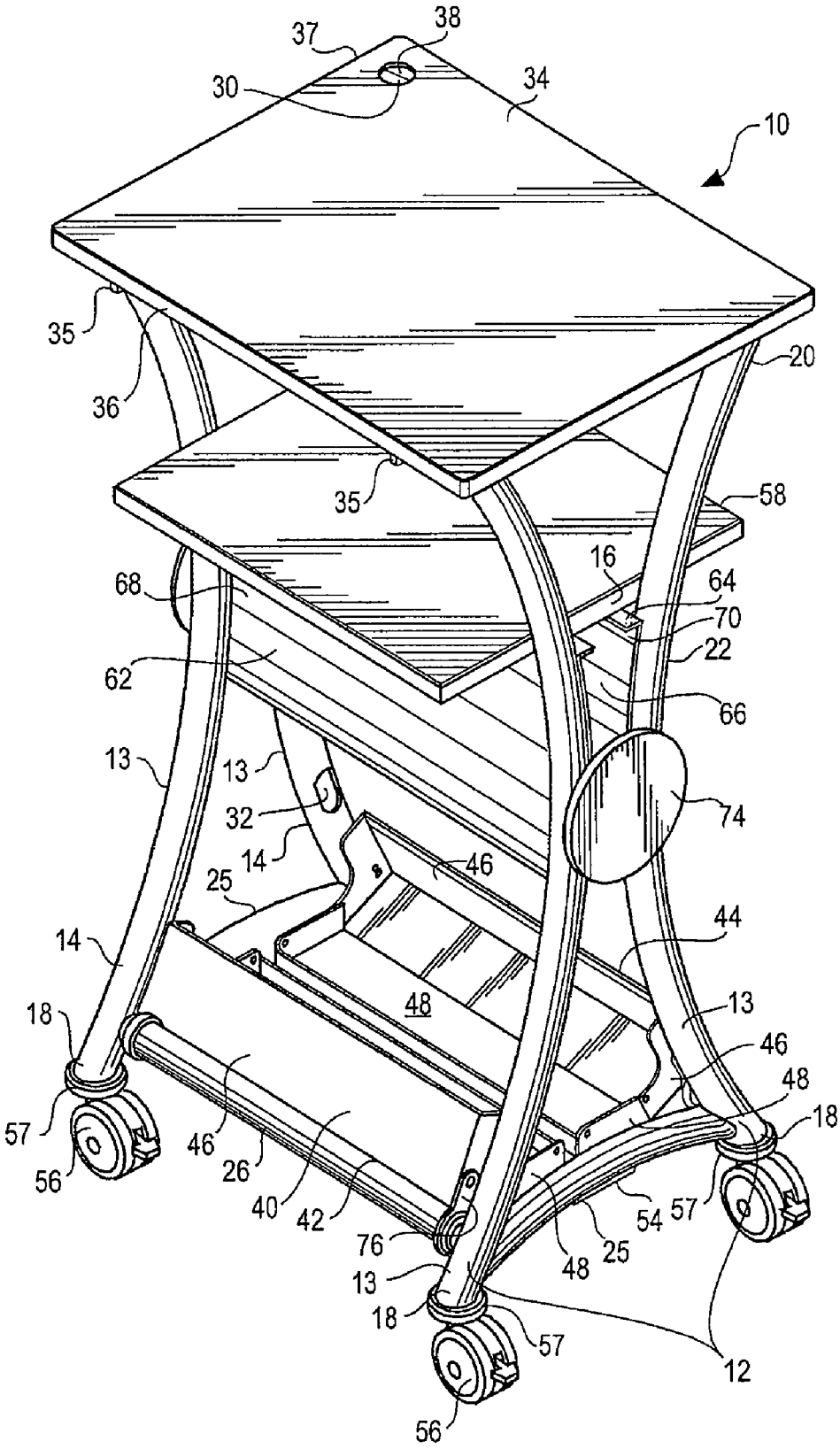
FIG. 1 is a perspective view of a first embodiment of the audio visual cart of the present invention.
Figure 1A:
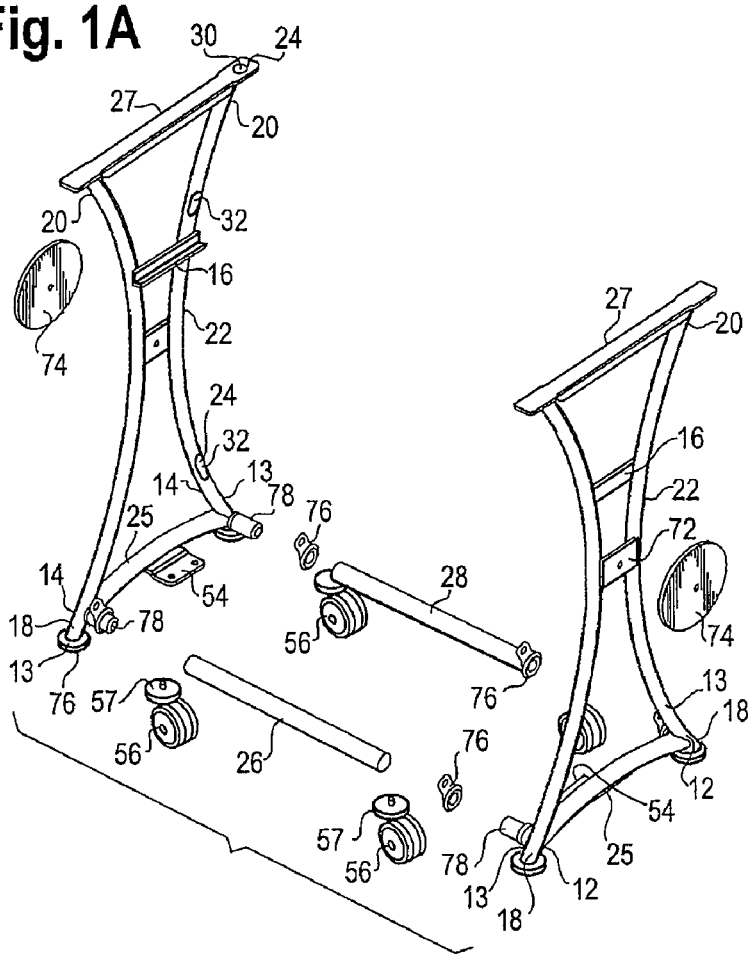
FIG. 1A is an exploded perspective assembly view of the legs, connector members and wheels for the cart shown in FIG. 1.
Figure 1B:
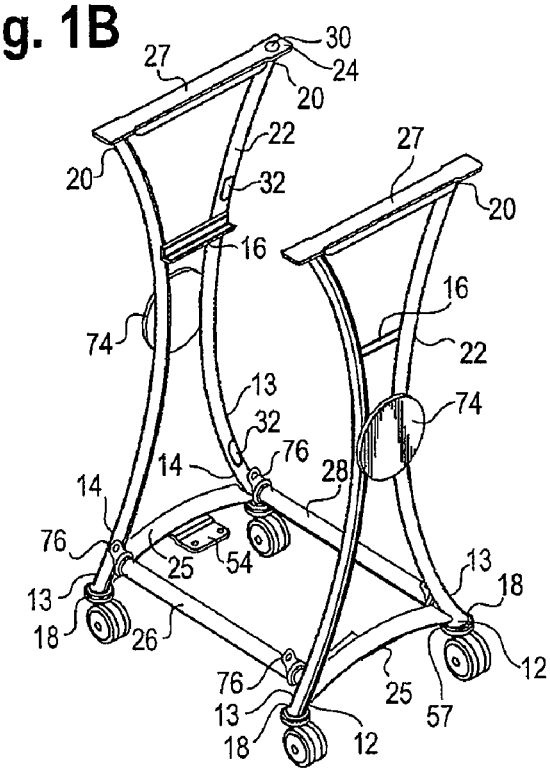
FIG. 1B is a perspective assembled view of the legs, connector members and wheels for the cart shown in FIG. 1.

In the illustrated embodiment of FIGS. 1, 1A and 1B, the cart 10 has two pairs of legs 12, 14, each pair comprising a leg 13. Each leg 13 has a curved contour and a generally cylindrical shape. Each pair of legs 12, 14 is secured by an L-shaped bracket 16 mounted on the legs 13 and available to support a shelf 58. Each leg 13 includes a bottom end 18, a top end 20, an outer wall 22, and an inner wall 24. In the illustrated embodiment, at least one leg 13 has a hollow interior defining a channel in that leg. Support members 25, 27 extend between each pair of legs 12, 14 at both the bottom end 18 and the top end 20 of each leg.

Figure 2:
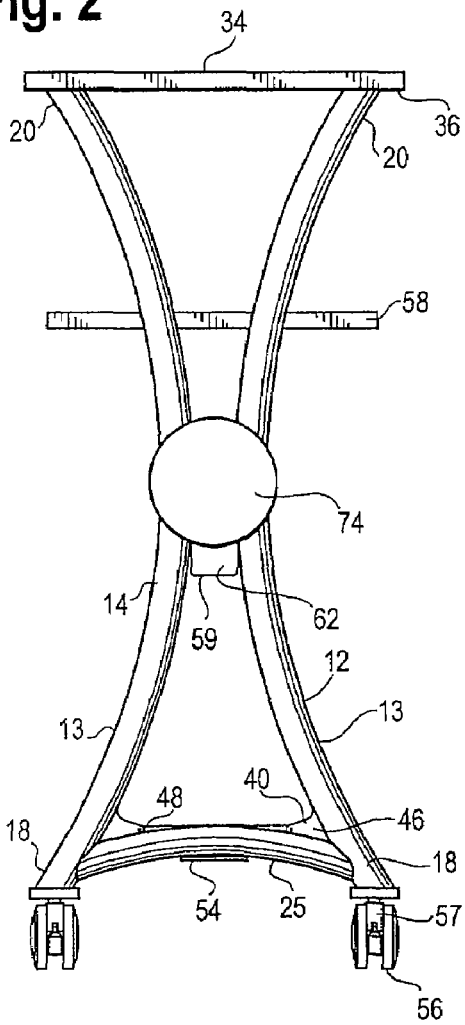
FIG. 2 is a side elevation view of the embodiment of the cart shown in FIG. 1.

As shown in FIGS. 1-2, the support member 25 mounted at the bottom end 18 of each leg 13 has a generally concave tubular shape. Each support member 27 (FIGS. 1A, 1B) mounted at the top end 20 of each leg has a flat upper surface. Connecting members 26 and 28 extend between and removably engage each pair of legs 12, 14 at the bottom end 18 of each leg 13 perpendicular to the plane of each pair of legs. As best seen in FIGS. 1 and 2, each leg 13 of the illustrated embodiment has a generally curved contour and a cylindrical shape. One of ordinary skill in the art will appreciate that other shapes and designs may be adopted for different applications.

At least one of the legs 13 has a hollow center 30 (FIG. 1A) extending through the entire length of the leg 13. At least one aperture 32 extends through the outer wall 22 of the hollow leg. As shown in FIGS. 1A and 1B, the illustrated cart 10 has one hollow leg at 30 and two apertures 32. Each aperture 32 communicates with the hollow center 30 of the leg 13. The hollow leg provides a user with a channel to conceal electrical wires or cables connected to equipment mounted on the cart 10 while using the cart to transport, store, or provide viewing of media and other displays with the audiovisual equipment. In an embodiment, the adjacent apertures 32 directly above and below L-shaped bracket 16 mounted on legs 12, 14 (FIGS. 2A and 2B) are designed to provide a security anchoring point for a thin aircraft or similar metal and plastic composite cable. When used with a small inline combination or key lock, the cable is designed to secure audio visual equipment, such as projectors, DVD players, and laptop computers on either or both the top shelf 34 or the middle shelf 58 to prevent theft.

Figure 1C:
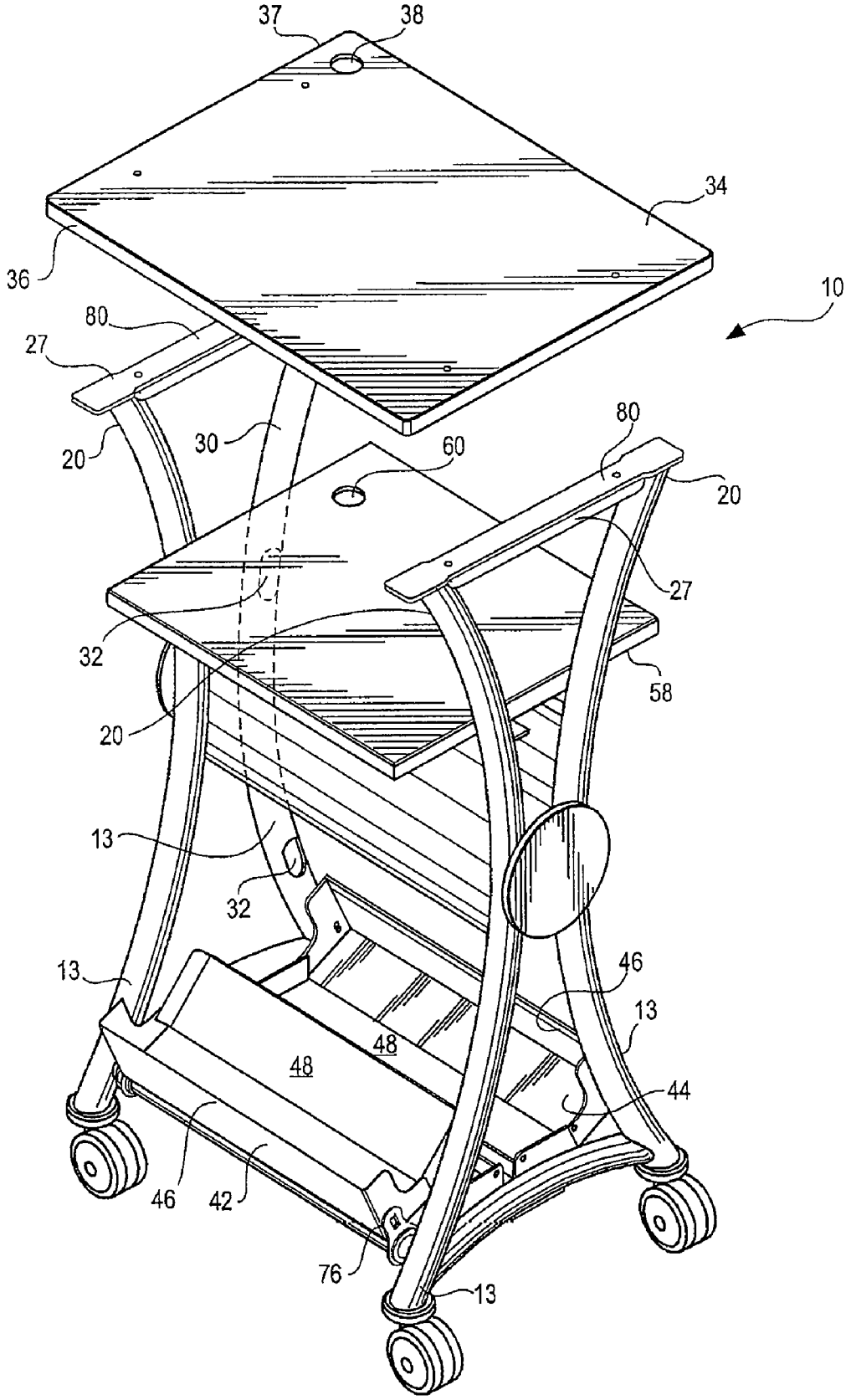
FIG. 1C is a partial exploded perspective assembly view of the cart of FIG. 1, the top shelf ready for assembly, and showing an aperture in the middle shelf.
Figure 4:
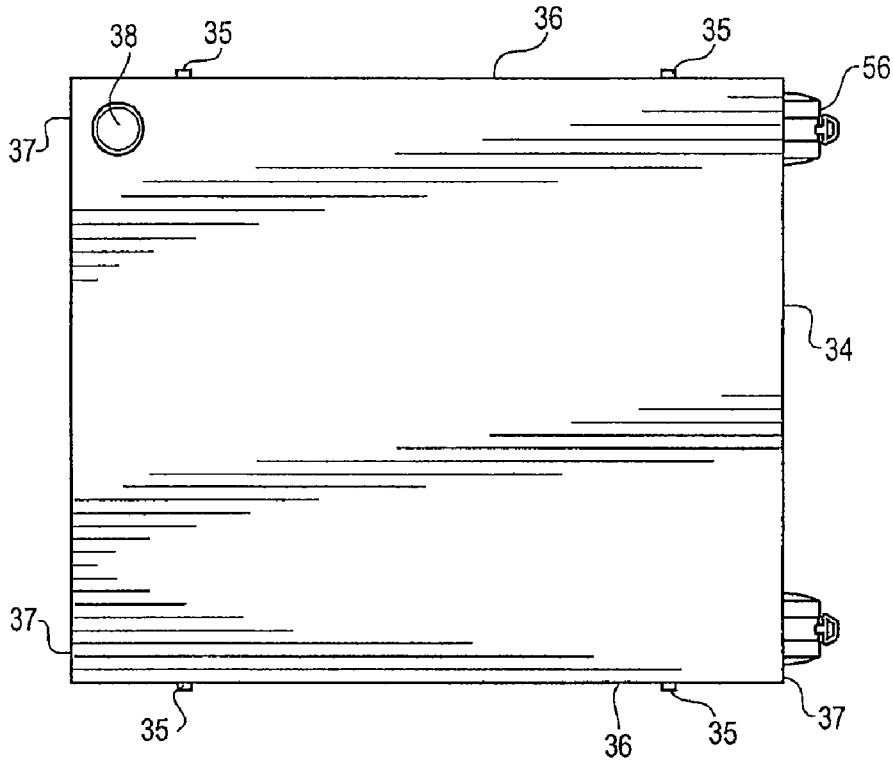
FIG. 4 is a top plan view of the cart shown in FIG. 1.
Figure 5:
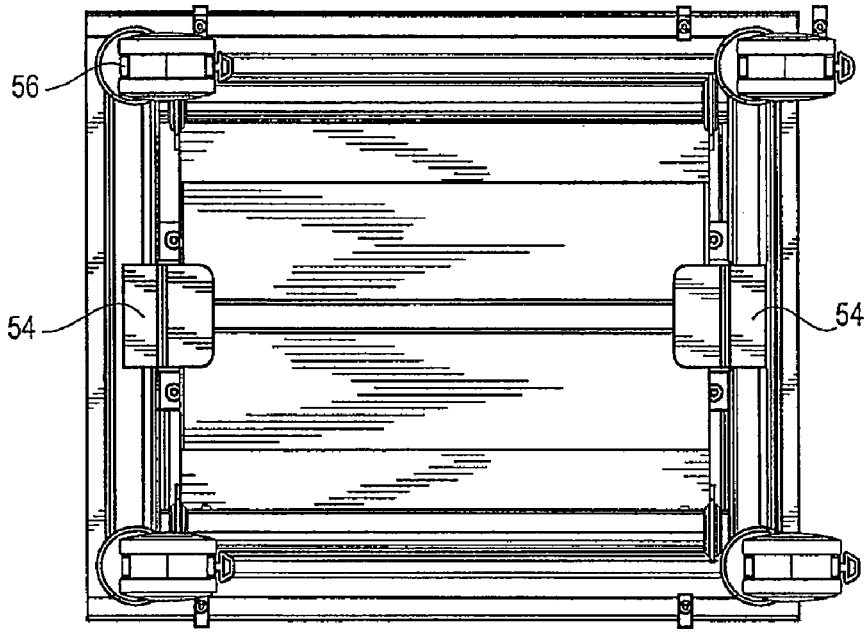
FIG. 5 is a bottom plan view of the cart shown in FIG. 1.
Figure 16:
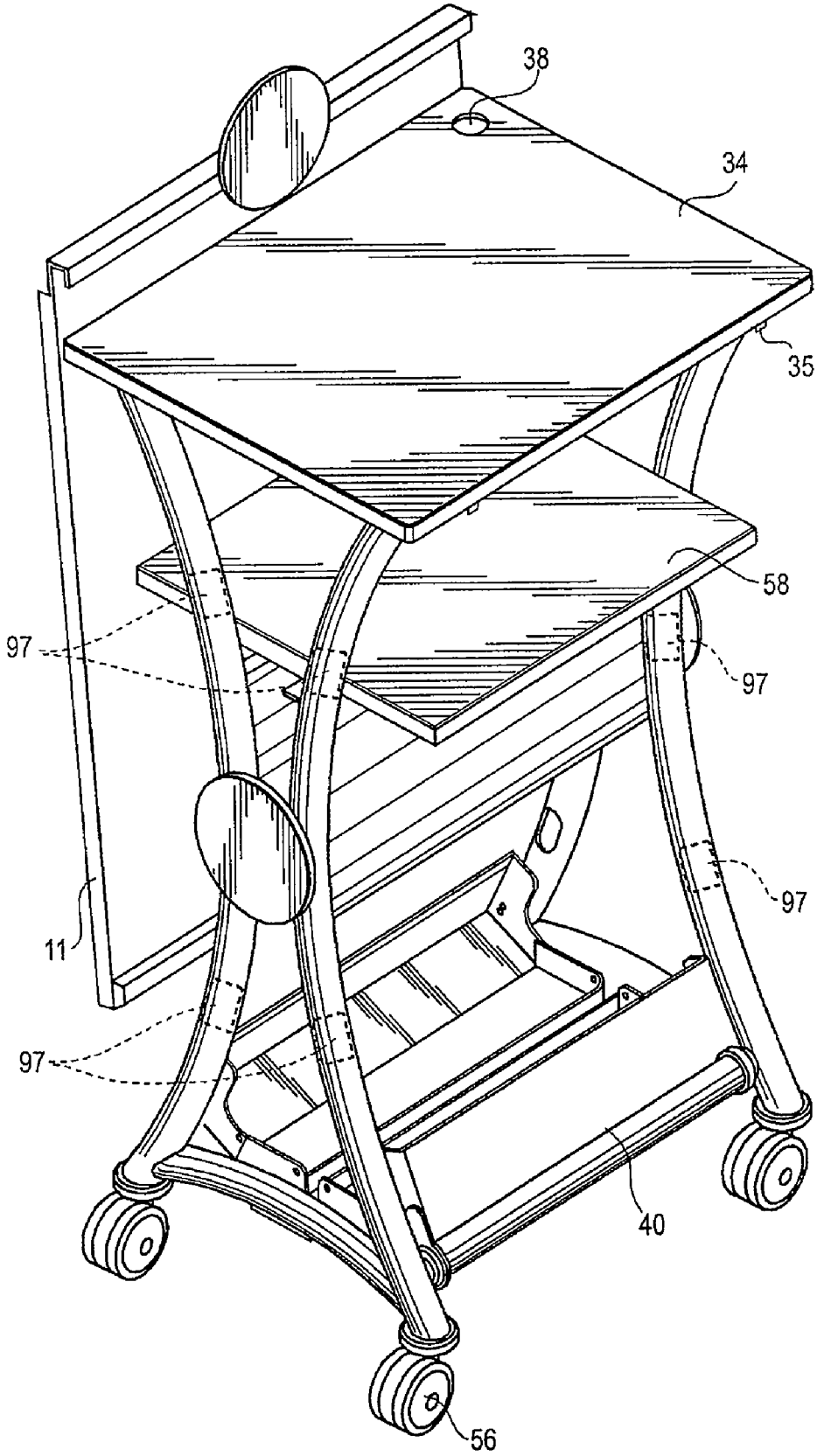
FIG. 16 is a perspective view of the cart shown in FIG. 1, having an easel removably attached to the top shelf of the cart via hook structures located on the top shelf of the cart.
Figure 17:
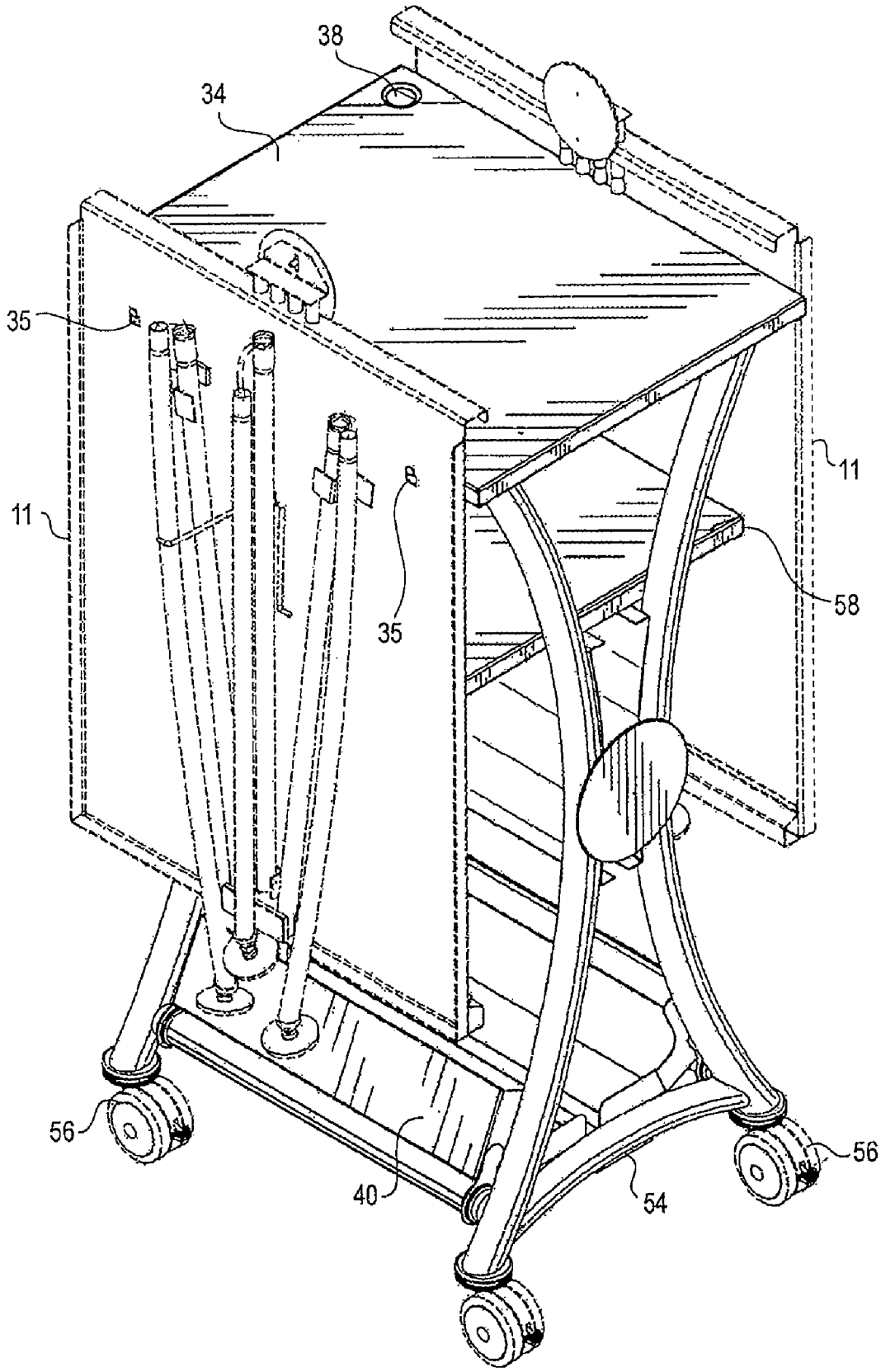
FIG. 17 is a perspective of the cart shown in FIG. 16 with two easels attached to the top shelf of the cart via a pair of hook structures located on the top shelf of the cart.

As shown in FIGS. 1-4, the cart 10 further includes a top shelf 34 mounted on the legs 12, 14 at the top end 20 of the legs. The top shelf 34 is attached to the support members 27 at the top end 20 of the legs (FIG. 1C). The shelf 34 further includes an outer edge 36 and at least one aperture 38 near a corner 37 of the shelf 34 (FIGS. 1, 1C). The aperture 38 communicates with the top 30 of hollow leg 13 to allow a user to conceal electrical wires leading to equipment placed on shelf 34 in the channel formed in hollow leg 13 while using the cart. As seen in FIG. 4, the top shelf 34 may also include hook structures 35 mounted to and extending from the outer edge 36 of the top shelf 34. The hook structures 35 allow other equipment, such as an easel, to be placed over the hooks 35 and removably attached to the cart for storage or transportation. (FIGS. 16, 17). As best seen in FIG. 17, multiple foldable leg easels 11, for example, may be mounted to the cart of the present invention using hooks 35. In an alternate embodiment, the hook structures 35 may be movably mounted to the bottom of the top shelf 34 and may also include an integrated sliding function to allow the easel 11 or other equipment to be placed over the hook 35 at various extension lengths from the cart 10 and be attached to the cart for storage or transportation.

Figure 2A:
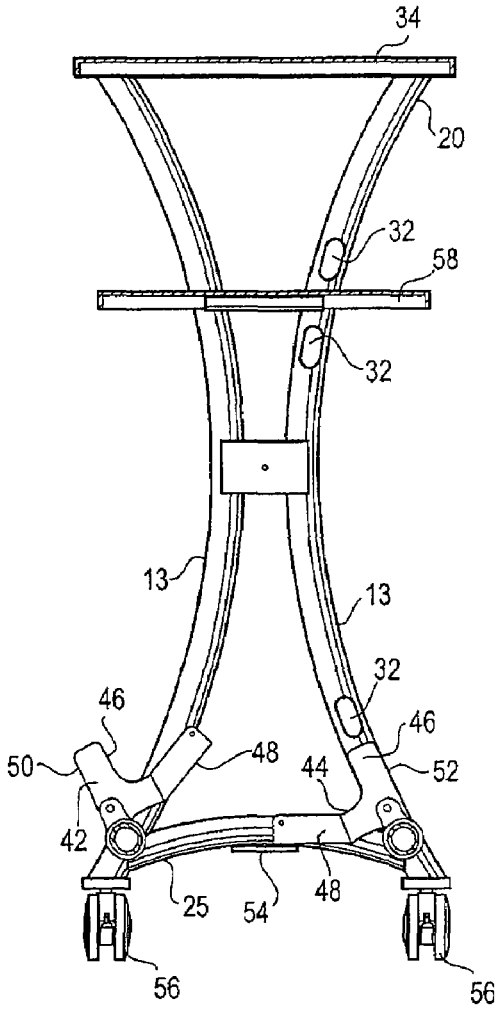
FIG. 2A is a side view of the cart as shown in FIG. 1, illustrating one portion of the lower utility shelf in the open position and the other shelf portion shown in the closed position.
Figure 2B:
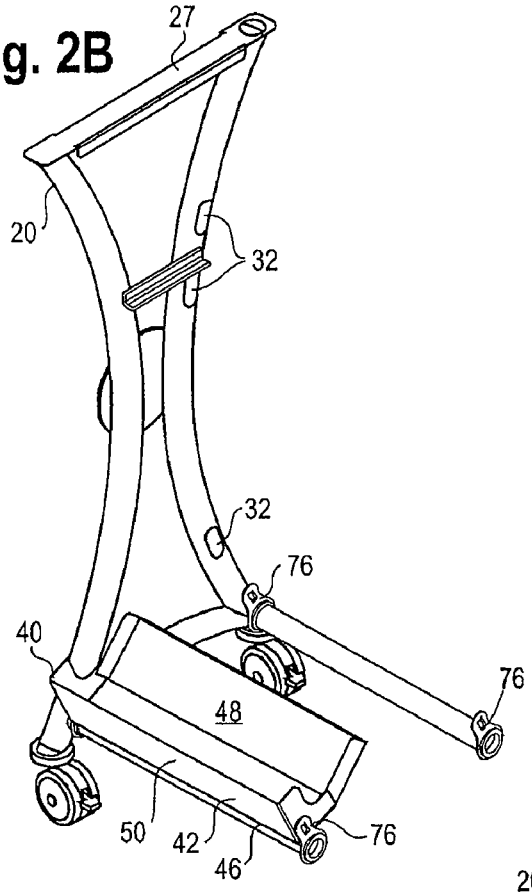
FIG. 2B is a partial perspective assembled view of the legs and connector members for the cart shown in FIG. 1, illustrating one portion of the lower utility shelf in the open position.
Figure 3:
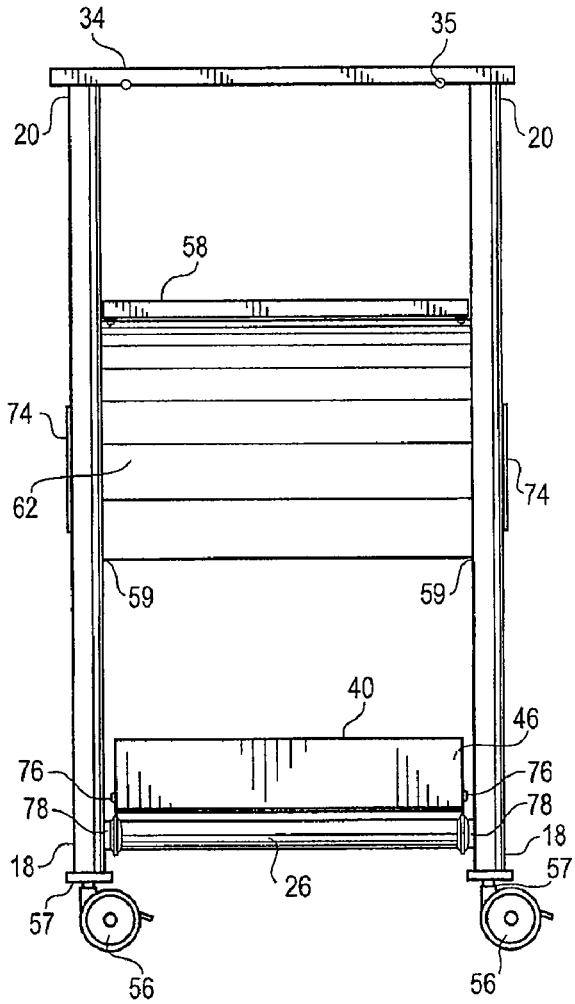
FIG. 3 is a front elevation view of the embodiment of the cart shown in FIG. 1.
Figure 18:
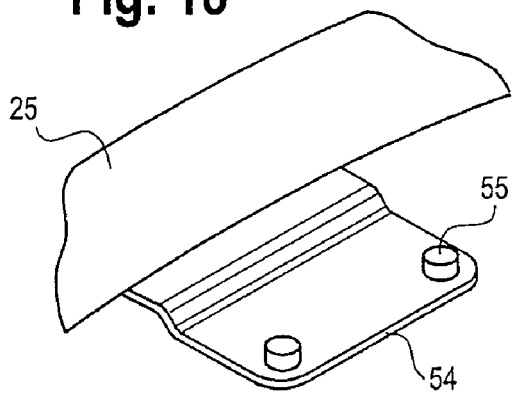
FIG. 18 is a detail view of the lower bracket for the utility shelf mounted to one of the connecting members.
Figure 19:
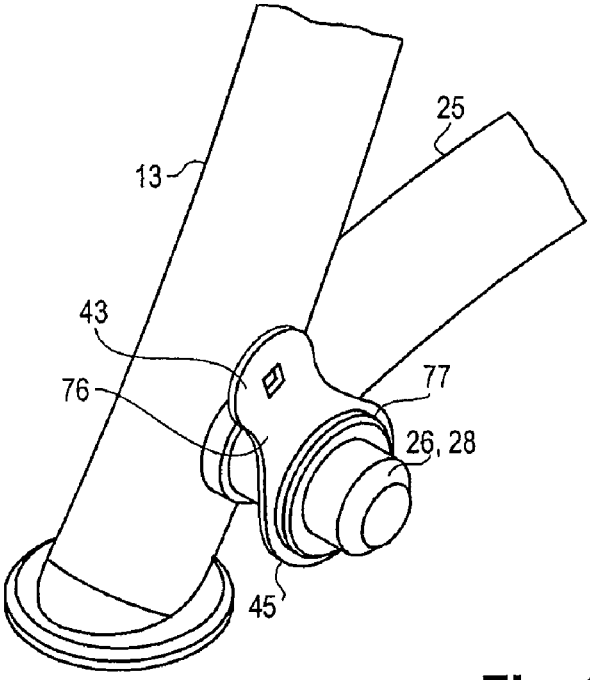
FIG. 19 is a detail view of the connector for the lower utility shelf.

A utility shelf assembly 40 (FIG. 1) is connected to the cart 10 near the bottom end of the legs 13 and adjacent the connecting members 25, 26, and includes a first portion 42 and a second portion 44. The first portion 42 and second portion 44 each have a vertical extending component 46 and a horizontal component 48, and each portion is pivotally connected to adjacent connecting members 26. Referring to FIGS. 2A and 2B, each portion 42, 44 of the utility shelf assembly 40 has a first open position 50 and a second closed position 52. In the closed position 52, the vertical component 46 is parallel to and hidden by each leg 13 to provide a clean aesthetic sight line when a user views the cart 10 from the side. The horizontal components 48 in the closed position 52 provide a flat storage space in the cart bottom. The embodiment shown in FIGS. 1-5 includes two lower brackets 54 shown in detail in FIG. 18. Referring to FIG. 18, each lower bracket 54 includes a pair of bumpers 55 upon which the underside of horizontal components 48 are supported when shelf portions 42, 44 are moved to their open position. The utility shelf portions 42, 44 are opened at the discretion of the user and will close under force of gravity. The utility shelf 40 is pivotally connected to connecting members 26, 28 by means of pivoting arm 76 shown in detail in FIG. 19 and FIG. 21. An extension 43 of pivoting arm 76 is attached to shelf 40 at each corner of the shelf 40 by a molded fastener 76*a*, and loop portion 45 of pivoting arm 76 extends slidably around respective extension 78 located at the bottom end 18 of each leg 13. Extension 43 in an embodiment comprises a blind quarter-turn injection fastener 76*a*. Pivoting arm 76 has a rubber o-ring 77 around the loop portion 45 to isolate the arm 76 from transmitting vibration to the shelves 40 and to provide a dampened motion as the shelves 40 are rotated into position. A set screw 99 shown on the inside of connecting members 26, 28 in FIG. 21 secures the ends of connecting members 26, 28 to extension 78 at the bottom end 18 of each leg 13. In the illustrated embodiment of FIG. 21 set screw 99 is a button-head cap screw.

The pairs of leg assemblies 12, 14 each include at least two pairs of caster mounted rollers or wheels 56 attached to the cart underneath each leg. Each wheel 56 further includes a caster assembly 57 to facilitate the axial rotational movement of the wheel 56 along a surface for transportation of the cart and to evenly distribute the load on all four casters or rollers as cart 10 moves along an uneven floor surface such that each caster bears a substantially equal weight. Caster assembly 57 is comprised of a rubber isolator 57*b* compressed between two metal plates 57*a* and 57*c*. One metal plate 57*a* is connected to the bottom of a respective leg 13 and the second metal plate 57*c* is attached to an upper portion of the caster assembly 57. The compressed rubber isolator 57*b* functions as a shock absorber extending and contracting in response to an individual caster's vertical and side motion as it encounters bumps or other surface imperfection on the floor. The rubber isolator 57*b* can be manufactured from a material having certain mechanical properties to enable a cart to move quietly and smoothly across semi-rough concrete or carpeted floors, such as for example and without limitation, natural black rubber, EPDM rubber, and silicone rubber. Each caster assembly 57 engages the bottom end 18 of a respective leg as shown in FIGS. 1-5 and FIG. 20. The wheels 56 are further coated with flexible material such as rubber or the like to minimize noise incurred while transporting the cart, as well as to ensure an even rotational area to compensate for manufacturing defects or normal wear and tear.

As seen in FIGS. 1 and 1C, a middle shelf 58 is mounted between the top shelf 34 and the lower utility shelf 40 of the cart of the present invention. As best seen in FIG. 1C, the middle shelf 58 also includes at least one aperture 60 extending through the shelf 58 near a coiner of the shelf 58, which aperture 60 communicates with the channel formed in hollow leg 30 through aperture 32 located just below shelf 58. In the embodiment shown in FIGS. 1-5, the middle shelf 58 extends horizontally to a width just shorter than the top shelf 34 and is parallel to the top shelf 34. As shown, the top shelf 34 and the middle shelf 58 have a rectangular shape; however one of ordinary skill in the art will appreciate that other shapes may be selected for different applications.

A pair of panels 62 (FIGS. 1, 3) extend in a curved configuration vertically downward beneath middle shelf 58. Panels 62 are attached to the bottom of L-shaped bracket 16, and middle shelf 58 is attached to the top of L-shaped bracket 16. (See FIGS. 1A and 1B). The panels 62 have a flange or ledge 64, an inner surface 66, and an outer surface 68. The shelf 58 is removably attached to L-shape bracket 16 connecting each pair of legs 12, 14. In the embodiment shown in FIGS. 1-5, the panels 62 have a horizontal dimension longer than the length of connecting members 26, 28 engaging the leg assemblies 12, 14, thus allowing each panel to be connected to an outer wall of each leg 13 at 70 (FIG. 1). The outer surface 68 of one of the pairs of panels 62 is attached to one leg from each pair of legs 12, 14, and the outer surface 68 of the second of the pair of panels 62 is attached to the other leg from each pair of legs 12, 14. The panels 62 are located proximal to the center space between the two pairs of legs 12, 14 and between the top shelf 34 and the lower utility shelf 40. Panel bracket 59 connects the bottom return flange 64 or ledge for the pair of panels 62 at each end of the panels. (See FIG. 2) As shown in FIGS. 1-2, each bracket 72 is further attached to a decorative disk 74 on an outer side of each pair of leg assemblies with each disk 74 being diametrically opposed from the other.

Figure 21:
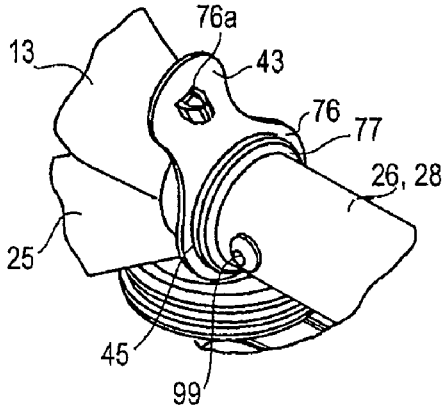
FIG. 21 is another detail view of the connector for the utility shelf shown in FIG. 19, also assembled between the connecting members and the leg assembly of the cart and showing a set screw on the inside of the connecting members to hold the connecting members in place.

The cart 10 of the present invention further provides a construction that enables the cart to be shipped as a flat disassembled product, and assembled with ease at the venue of use. As shown in FIGS. 1A, 1B, and 21, button head cap screw fasteners 99 connect the connecting members 26, 28 to an extension 78 located at the bottom end 18 of each leg 13. The button head cap screw fasteners 99 allow the connecting members 26, 28 to be disassembled from the pairs of leg assemblies 12, 14 such that the leg assemblies may be shipped in a flat configuration (See FIG. 21). In FIG. 1C, the shelf 34 is further removable from its support upon the leg assemblies 12, 14 as shown at 80. After removal, the shelf 34 can be laid flat along the separate leg assemblies for shipment. Middle shelf 58 may equally be removed from L-shaped bracket 16 for shipment in the flat configuration.

In operation, the cart 10 as shown in the illustrated embodiments can be shipped disassembled in a flat or other convenient packaging. When a user sets up the cart 10 as shown in FIG. 1 with the desired audio visual, electronic or other equipment, such as a television set, VCR, CD or DVD player, monitor, or the like, supported on the shelves 34, 58, any electrical wires or cables are inserted into apertures 38 and/or 60 in the respective shelves and down through the channel formed in hollow leg 13. Interconnection electrical cables between a laptop and a projector located in shelf 34, 58, or 40 may also be routed from one shelf to another through aperture 32 conveniently positioned at various locations on hollow leg 13. The utility shelf 40 at the bottom of the cart 10 is used in the open position to store the electrical wiring or other accessory items as desired by the user.

Figure 20:
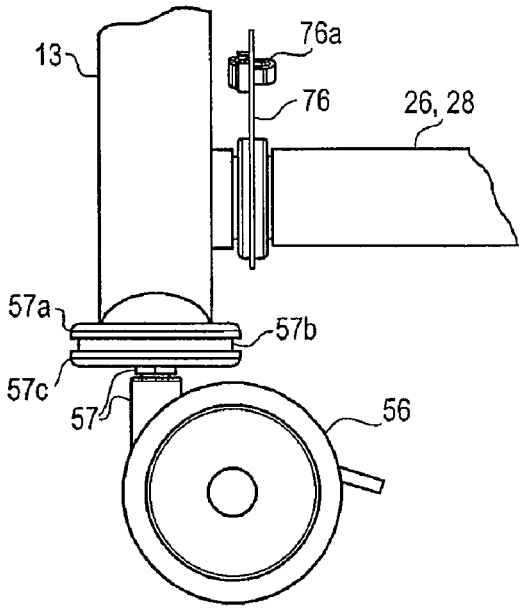
FIG. 20 is a side detail view of the caster assembly for the cart shown in FIG. 1 and the connector for the utility shelf shown in FIG. 19 assembled between the connecting members and the legs of the cart.

For equipment located on the top shelf 34, the electrical wires are inserted through the aperture 38 in the top shelf 34, snaked through the hollow leg at 30, and out the lower aperture 32 (FIG. 1) and through the outer wall of the leg 13 near the utility shelf 40 at the bottom end 18 of the hollow leg 13. For equipment located on middle shelf 58, electrical wires are inserted through the aperture 60 in the middle shelf and into the hollow leg 13 through the aperture 32 located just below the middle shelf 58. The wires are then snaked out through the lower aperture 32 (FIG. 1) in the outer wall of the leg 13 near the utility shelf 40 at the bottom end 18 of the leg 13. Thus, wires extending from electric or electronic equipment supported on either shelf 34 or 58 are substantially concealed from view. If a user needs to move or transport the cart, the caster wheel assemblies 57 will provide easy movement of the cart 10 and a rubber coating on the wheels 56 will reduce noise and provide an even rotational surface (FIG. 20). As shown in FIGS. 16 and 17, a user may also mount one or two easels to the top shelf of the cart for transport via the hook structures located on the top shelf of the cart.

An alternate embodiment of the cart of the present invention is shown in FIGS. 6-10. This embodiment has a shorter overall height dimension relative to the first embodiment and only a single horizontal shelf, but the majority of the structures and features are similar to that shown in FIGS. 1-5. In the illustrated embodiment of FIGS. 6, 6A and 6B, the cart 110 has two pairs of legs 112, 114. Each pair of legs includes curved legs 113, and each pair of legs 112, 114 is secured by a bracket 116 mounted between the legs 113. Each leg 113 further includes a bottom end 118, a top end 120, an outer wall 122, and an inner wall 124. Support members 125, 127 extend between each pair of legs 112, 114 at both the bottom end 118 and the top end 120 of each leg.

Figure 6:
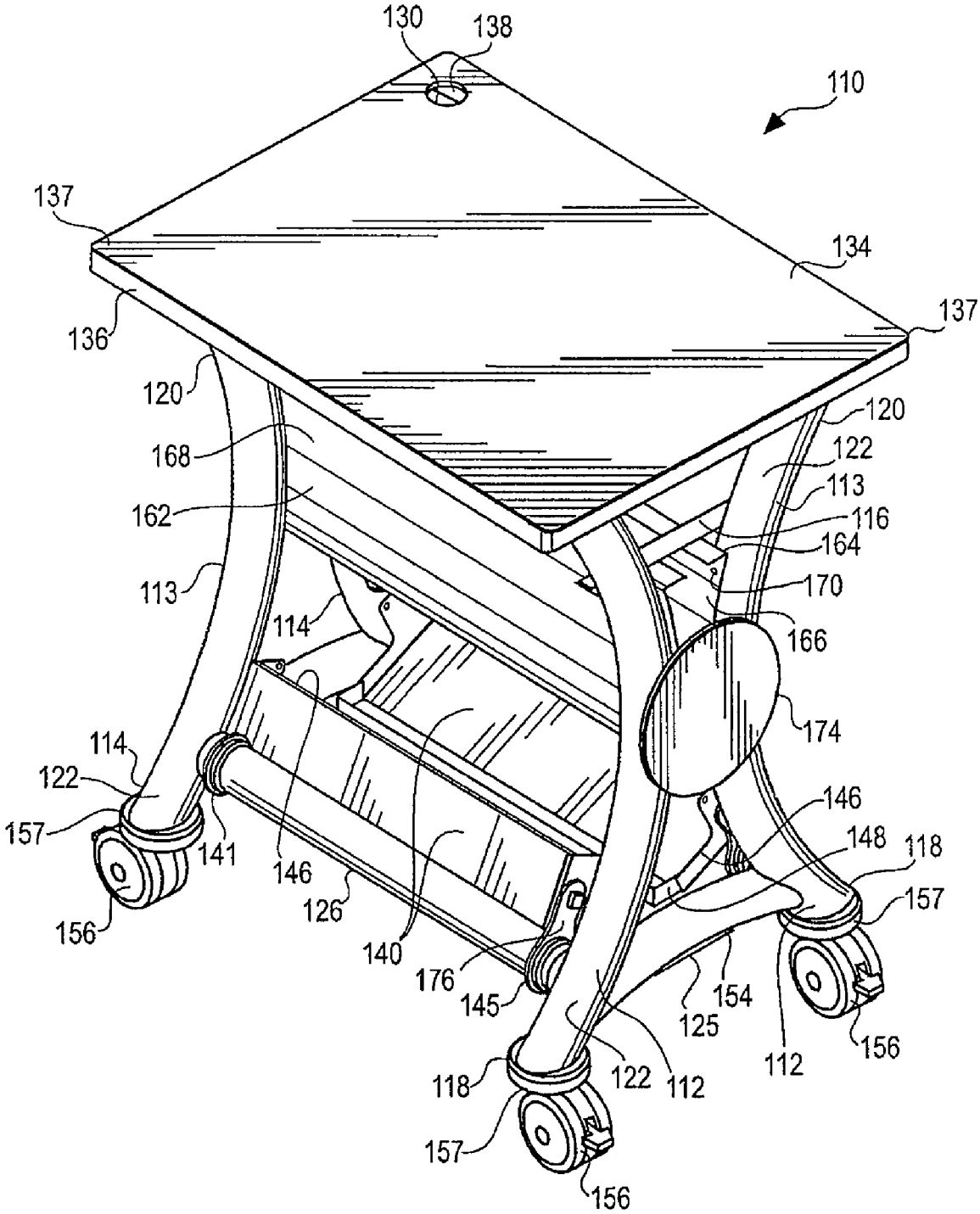
FIG. 6 is a perspective view of a second embodiment of the audiovisual cart of the present invention.
Figure 6A:
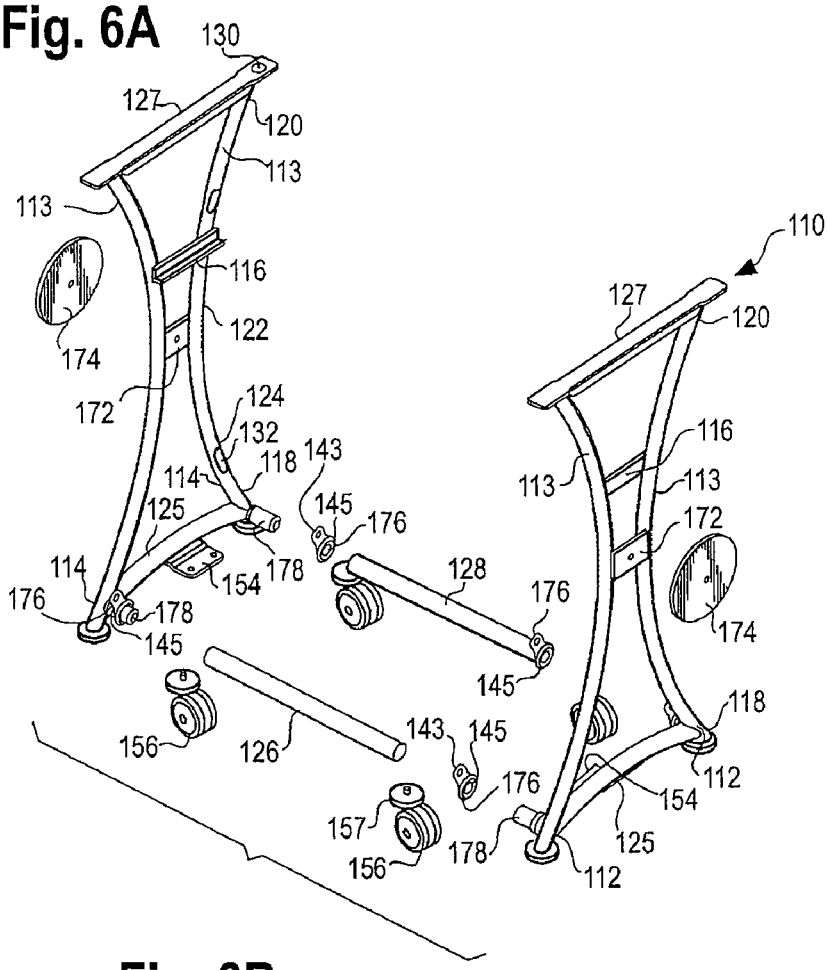
FIG. 6A is an exploded perspective assembly view of the legs, connector members and wheels for the cart shown in FIG. 6.
Figure 6B:
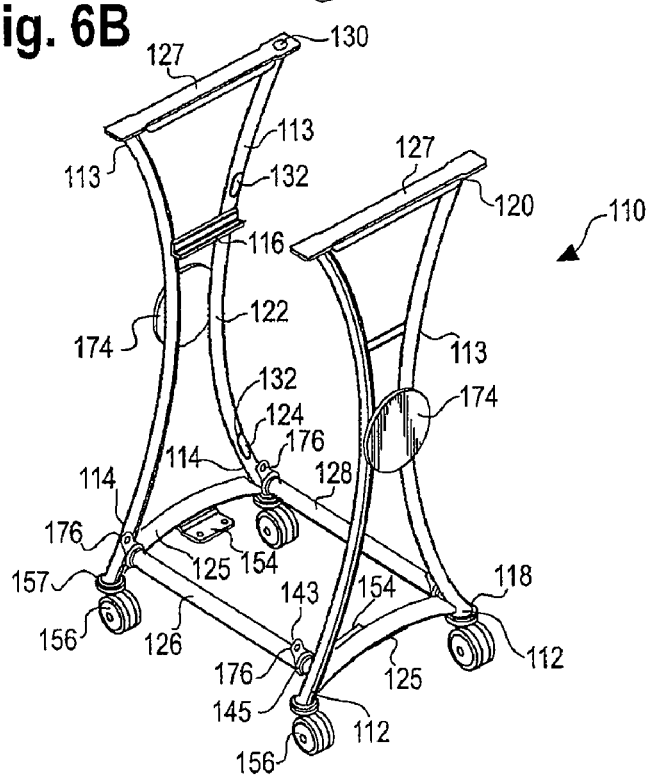
FIG. 6B is a perspective assembled view of the legs, connector members and wheels for the cart shown in FIG. 6.
Figure 7:
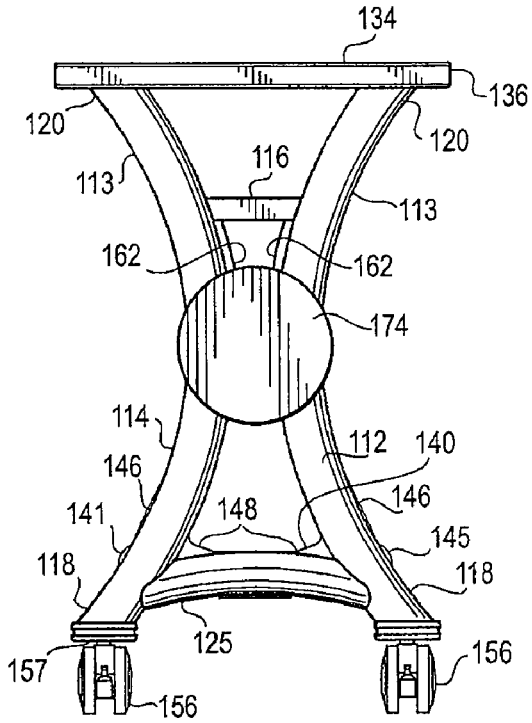
FIG. 7 is a side elevation view of the embodiment of the cart shown in FIG. 6.

As shown in FIG. 6-7, the support member 125 mounted at the bottom end 118 of each leg 113 has a generally concave tubular shape relative to a ground level. Each support member 127 mounted at the top end 120 of each leg has a flat upper portion, adapted to support shelf 134. Connecting members 126 and 128 extend between and engage each pair of legs 112, 114 at the bottom end 118 of each leg 113 perpendicular to the plane of each pair of legs. In the illustrated embodiment of FIGS. 6-10, the legs 113 have a generally curved contour and a cylindrical shape. One of ordinary skill in the art will appreciate that other shapes and designs may be adopted for different applications. At least one of the legs 113 has a hollow center 130 (FIG. 6A) forming a channel extending through the entire length of the leg 113, and a pair of apertures 132 through the outer wall 122 of the hollow leg communicate with the hollow interior of the leg. As shown in FIGS. 6A and 6B, the cart 110 has one hollow leg at 130. The hollow leg provides a user with a place to extend and conceal electrical wires or other equipment while using the cart to support and operate audiovisual equipment.

Top shelf 134 is mounted on the legs 112, 114 at the top end 120 of the legs. As shown in FIGS. 6-9, the top shelf 134 is removably attached to the support members 127. The shelf further includes an outer edge 136 and at least one aperture 138 near a corner 137 of the shelf 134. The aperture 138 communicates with the hollow leg 130 to allow a user to extend and conceal electrical wires or other equipment while using the cart 110.

A utility shelf 140 is pivotally connected at the bottom end 118 of each pair of legs 112, 114. The utility shelf 140 has a first portion 142 and a second portion 144. The first portion 142 and second portion 144 each have a vertical component 146 and horizontal component 148. The utility shelf 140 is pivotally connected to connecting members 126, 128 by means of pivoting arm 176. The details of pivoting aim 176 are identical to the details described for connector 76 as disclosed above with reference to FIGS. 19, 21. An extension 143 of pivoting arm 176 is attached to shelf 140 at each corner of the shelf 140 by molded fastener 176*a*, and loop portion 145 of fastener 176 extends slidably around respective extension 178 located at the bottom end 118 of each leg 113. As disclosed above with reference to FIGS. 19 and 21, a button-head cap screw 99 shown on the inside of connecting members 126, 128 in FIG. 21 secures the ends of connecting members 126, 128 to extension 178 between each pair of legs 112, 114.

Each portion of the utility shelf 140 has a first open position 50 and a second closed position 52 as previously shown for the first embodiment in FIG. 2A. In the closed position 52, the vertical components 146 are parallel to and hidden from the side view by each respective leg 113 to provide a clean aesthetic sight line when a user views the cart from the side. The horizontal components 148 in the closed position 52 provide a flat storage space on the bottom of the cart 110 while resting on a lower bracket 154 and bumpers 55 connected to the horizontal support members 125, as described in conjunction with FIG. 18. The embodiment shown in FIGS. 6-10 includes two lower brackets 154, each having bumpers 55.

The pairs of leg assemblies 112, 114 each include at least two wheels 156, with each pair of wheels attached to the cart 110 underneath each pair of legs. Each wheel 156 is mounted to the bottom 118 of each leg 113, and includes a rotatable caster assembly 157 to facilitate the rotational movement of the wheels 156 along a surface to transport the cart 110. The structure and function of the rotatable caster assembly 157 comprising rubber isolator 157*b* between metal plates 157*a* and 157*c* is similar to that shown for the first embodiment in FIG. 20. Rubber isolator 157*b* functions as a shock absorber to ensure that all four casters or wheels contact the floor to equally distribute the load and to minimize noise transmission while the cart is in motion. The wheels 156 are further coated with flexible material such as rubber or the like to minimize noise incurred while transporting the cart, as well as to ensure an even rotational area in the event of manufacturing defects or normal wear and tear.

Figure 8:
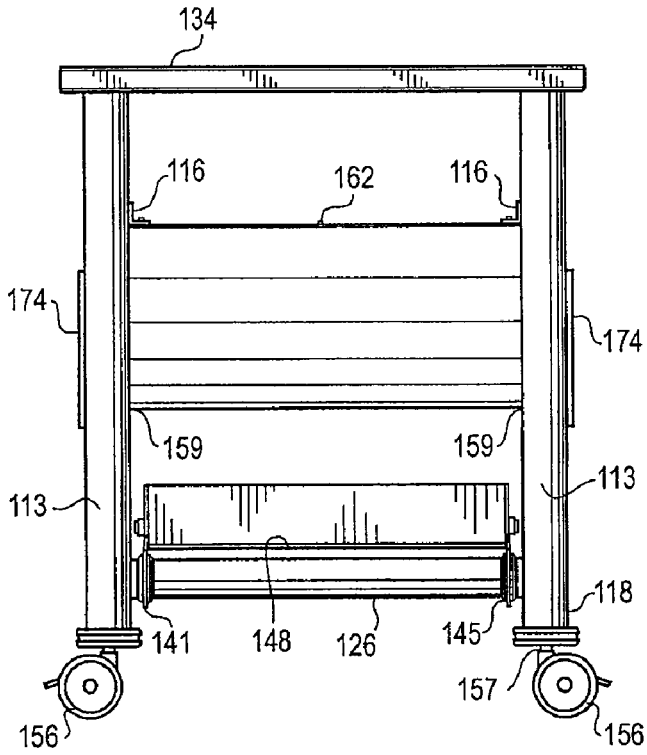
FIG. 8 is a front elevation view of the embodiment of the cart shown in FIG. 6.
Figure 9:
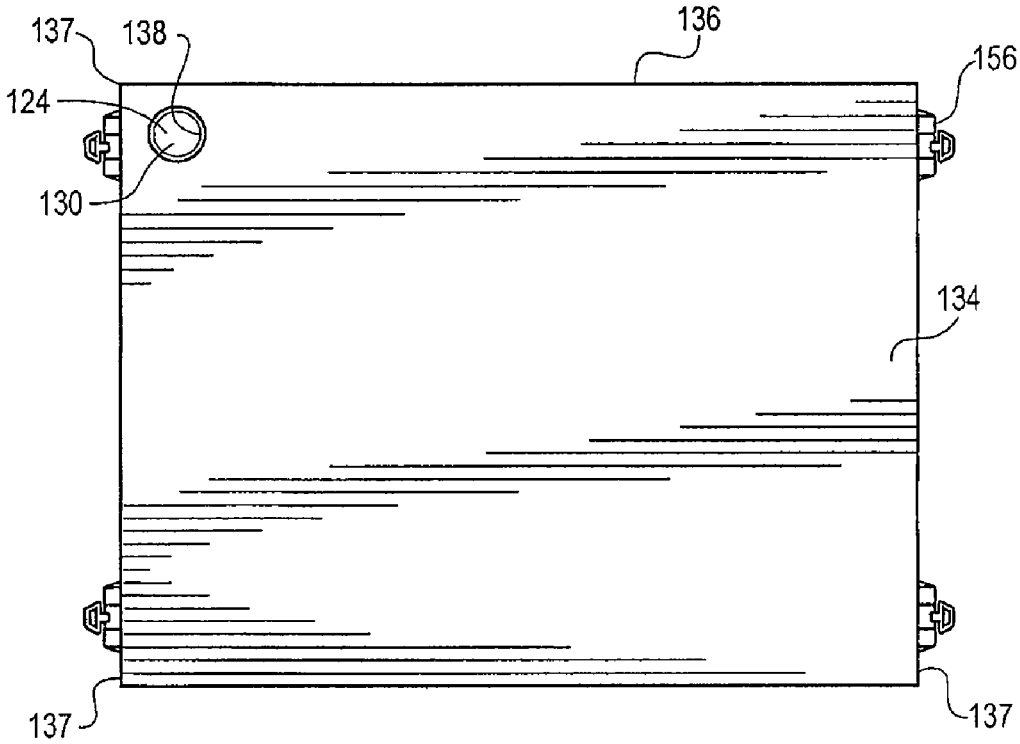
FIG. 9 is a top plan view of the cart shown in FIG. 6.
Figure 10:
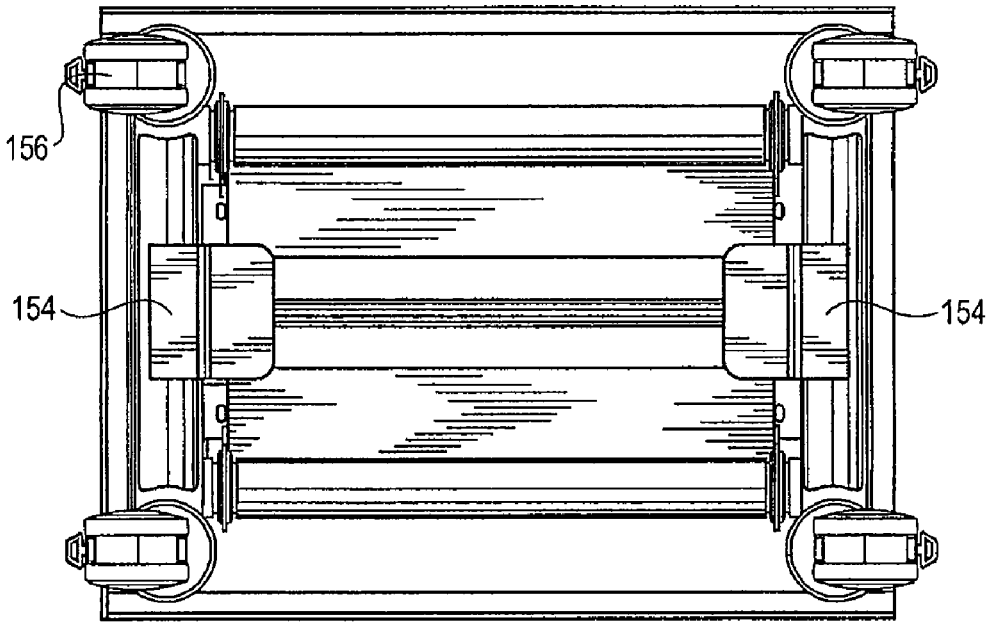
FIG. 10 is a bottom plan view of the cart shown in FIG. 6.

As seen in FIGS. 6 and 8, a pair of substantially vertically extending panels 162 is located proximal to the center space between the two pairs of legs 112, 114 and between the top shelf 134 and the utility shelf 140. The panels 162 have a ledge 164, an inner surface 166, and an outer surface 168. In the embodiment shown in FIGS. 6 and 8, the panels 162 have a length longer than the connecting members 126,128 engaging the leg assemblies 112, 114, allowing the panels to be connected to an outer wall 122 of each leg 113 as shown at 170. The panels 162 are attached to L-shaped bracket 116 (FIG. 7) at either end of each panel. At the bottom of panel 162, a bracket 159 connects the bottom return flange or ledge 164 for the pair of panels 162 at each end of the panels. Also, a bracket 172 (FIG. 6A) is attached to a decorative disk 174 on an outer side of each pair of leg assemblies 112, 114, with each disk 174 being diametrically opposed from the other.

The cart 110 of the present invention further provides assembly and disassembly, enabling the cart to be shipped in a flat configuration, and assembled with ease at the venue of use similar to that previously described for the first embodiment. As shown in FIG. 21, button-head cap screw 99 connects the connecting members 126,128 to an extension 178 located at the bottom end 118 of each leg 113 with a structure and function similar to that described for the first embodiment. The screws 99 allow the connecting members 126, 128 to be disassembled from the pairs of leg assemblies 112, 114 such that the leg assemblies may be shipped in a flat configuration. The shelf 134 is further removable from its support upon the leg assemblies 112, 114. After removal, the shelf 134 can be laid flat along separate leg assemblies for shipment. This feature provides for convenient, economical shipping of the present invention.

In operation, the cart 110 as shown in the illustrated embodiment of FIGS. 6-10 can be shipped in flat or other convenient packaging. When a user sets up the cart as shown in FIG. 6, with the desired audio visual, electronic or other equipment, such as a television set, VCR, CD or DVD player, monitor, or the like, on the shelf 134, any electrical wires or cables are inserted into aperture 138 in the shelf 134 and down through the channel 130 in hollow leg 113. The utility shelf 140 at the bottom of the cart 110 may be used to store the electrical wiring, cable or other accessory items as desired by the user.

For equipment located on shelf 134, the electrical wires are inserted into and snaked through the aperture 138 in the shelf 134, through the hollow leg at 130, and out the aperture 132 at the lower end of hollow leg 113 (FIGS. 6A, B). The wire or cable then extends through the outer wall of the leg 113 near the utility shelf 140 at the bottom end 118 of the leg 113. The wires are then pulled out through the aperture 132 located near the utility shelf 140. Thus, wires extending from equipment supported on shelf 134 are substantially concealed from view. Interconnection electrical cables between a laptop and a projector located in shelf 134 or 140 may also be routed from one shelf to another through aperture 132 conveniently positioned at various locations on hollow leg 113. If a user needs to move or transport the cart, the caster wheel assemblies 157 will provide easy movement of the cart and the rubber coating on the wheels 156 will reduce noise and provide an even rotational surface. As shown in FIGS. 16 and 17, a user may also mount one or two easels to the top shelf of the cart for transport via the hook structures located on the top shelf of the cart.

A third embodiment of the cart of the present invention is shown in FIGS. 11-15. A large portion of the structural and functional features are similar to the cart shown in FIGS. 1-5.

Figure 11:
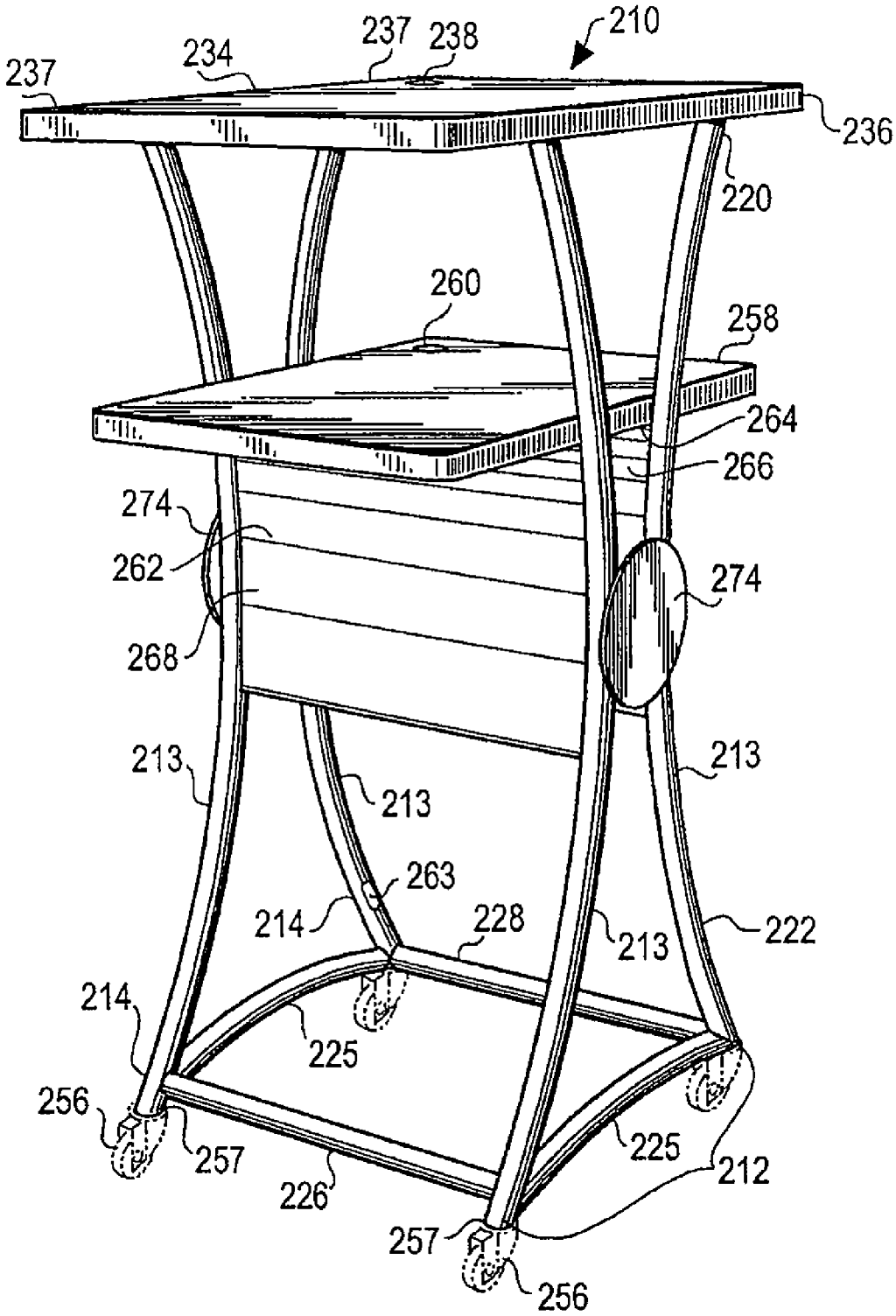
FIG. 11 is a perspective view of a lower cost, third embodiment of the audiovisual cart of the present invention, eliminating certain features of the previous embodiment.
Figure 11A:
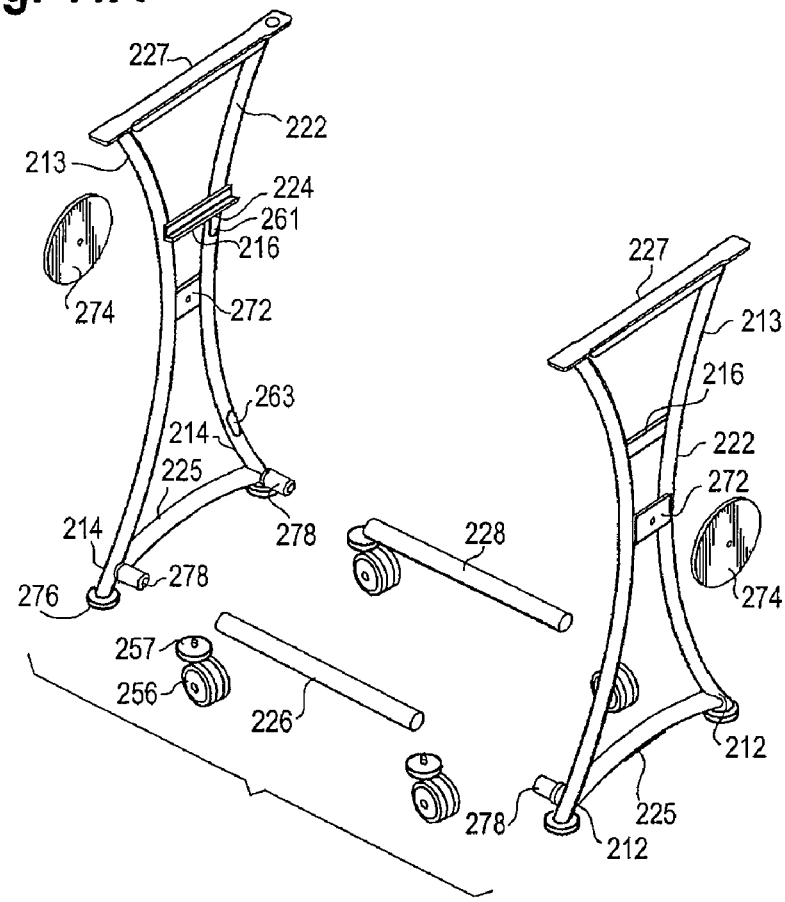
FIG. 11A is an exploded perspective assembly view of the legs, connector members and wheels for the cart shown in FIG. 11.
Figure 11B:
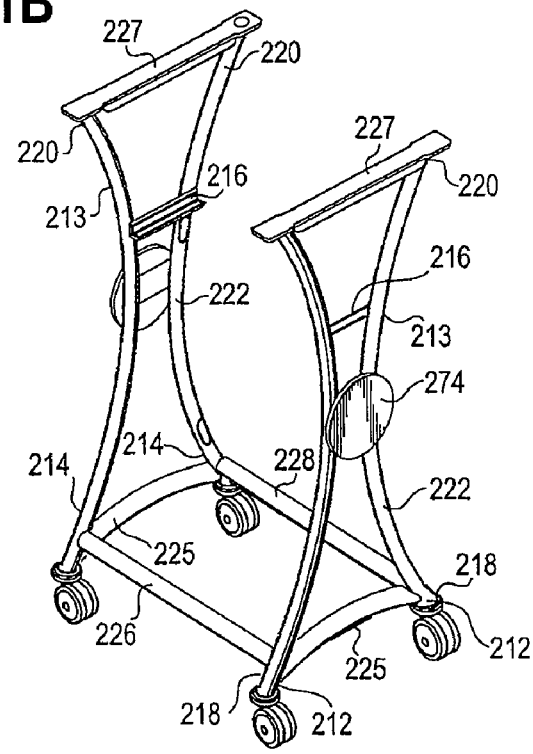
FIG. 11B is a perspective assembled view of the legs, connector members and wheels for the cart shown in FIG. 11.
Figure 12:
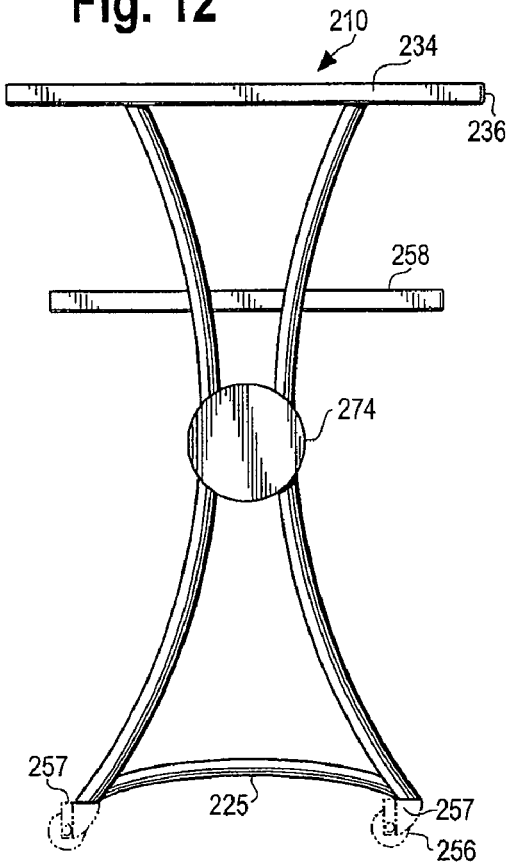
FIG. 12 is a side elevation view of the cart shown in FIG. 11.
Figure 13:
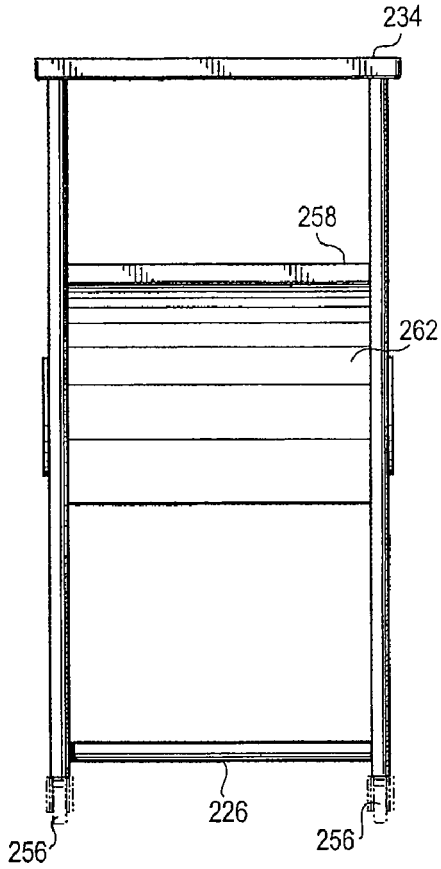
FIG. 13 is a front elevation view of the cart shown in FIG. 11.

In the illustrated embodiment of FIGS. 11, 11A and 11B, the cart 210 has two pairs of legs 212, 214 comprising individual curved legs 213. Each pair of legs 212, 214 is secured by a bracket 216 mounted to each leg 213 and each bracket has a flat surface to support a shelf 258. Each leg 213 further includes a bottom end 218, a top end 220, and an outer wall 222. One of the legs 213 has a hollow channel 224 (FIG. 14) extending along the length of the leg. Support members 225, 227 (FIGS. 11A, B) extend between each pair of legs 212, 214 at the bottom end 218 and the top end 220 of each leg respectively. As shown in FIG. 11-12, the support member 225 mounted at the bottom end 218 of each leg 213 has a generally concave tubular shape relative to a ground level. Support member 227 mounted at the top end 220 of each leg has a flat upper surface adapted to removably mount top shelf 234.

Connecting members 226 and 228 extend between and engage each pair of legs 212, 214 at the bottom end 218 of each leg 213 perpendicular to the plane of each pair of legs. In the illustrated embodiment of FIGS. 11-15, the legs 213 have a generally curved contour and a cylindrical shape. One of ordinary skill in the art will appreciate that other shapes and designs may be adopted for different applications.

Figure 14:
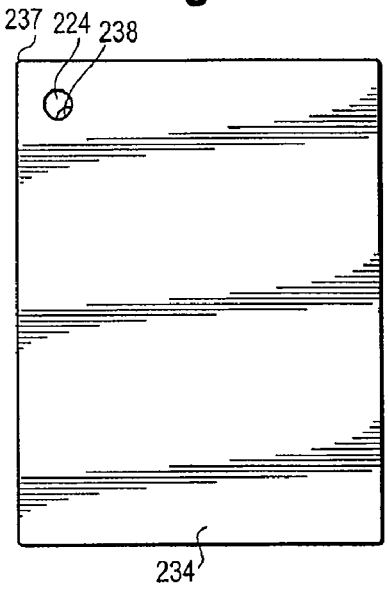
FIG. 14 is a top plan view of the top shelf for the cart shown in FIG. 11.
Figure 15:
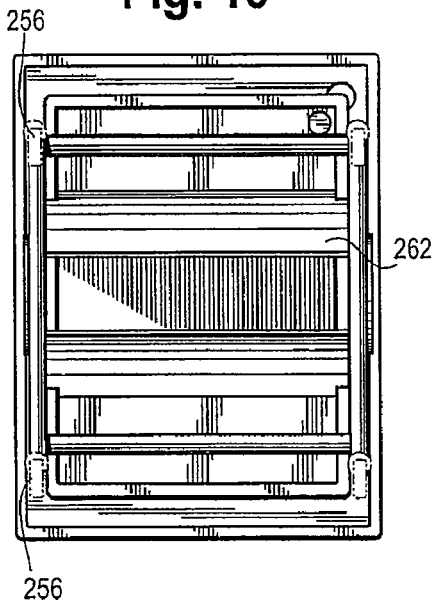
FIG. 15 is a bottom plan view of the cart shown in FIG. 11.

Shelf 234 includes an outer edge 236 and at least one aperture 238 near a corner 237 of the shelf 234 (FIG. 14). The aperture 238 communicates with channel 224 extending through the hollow leg 213 to provide a user with a place to extend and conceal electrical wires, cables or other equipment while using the cart 210 to support and operate audio visual equipment.

The pairs of leg assemblies 212, 214 include at least two pairs of wheels 256 with each pair of wheels attached to the cart underneath each pair of legs. Each wheel further includes a caster assembly 257 to facilitate the rotational movement of the wheel along a surface and transport the cart. The caster assembly engages the bottom end 218 of each leg as shown in FIGS. 11-15. The wheels are further coated with flexible material such as rubber or the like to minimize noise incurred while transporting the cart as well as to ensure an even rotational area in the event of manufacturing defects or normal wear and tear.

A middle shelf 258 is mounted between the top shelf 234 and the bottom connecting and support members 225, 226 of the cart 210 of the present invention. In the embodiment shown in FIGS. 11-15, the middle shelf 258 extends horizontally to a width just shorter than the top shelf 234 and is parallel to the top shelf 234. As shown, the top shelf 234 and the middle shelf 258 have a rectangular shape. One of ordinary skill in the art will appreciate that other shapes may be selected for different applications.

An aperture 260 (FIG. 11) in the middle shelf 258 provides a user with a place to extend electrical wires or cables while using middle shelf 258 to support audiovisual equipment while in use, or in storage. Aperture 261 (FIG. 11A) in hollow leg 213 provides access through which channel 224 receives the wires and cables extended through aperture 260. The wires or cables then exit channel 224 at aperture 263 in the bottom of hollow leg 213.

As described for the embodiment of FIGS. 1-5, a pair of panels 262 extend vertically downward in a curved configuration beneath middle shelf 258. Panel 262 is attached to the bottom of L-shaped bracket 216, and middle shelf 258 is attached to the top of the L-shaped bracket 216. The panels 262 have a ledge 264, an inner surface 266 and an outer surface 268. The shelf 258 is removably attached to the ledge 264 of the pair of panels 262. In the embodiment shown in FIGS. 11-15, the panels 262 have a length equal to the connecting members 226, 228 and engage the leg assemblies 212, 214 at the outer wall 222 of each leg. The outer surface 268 of one of the pairs of panels 262 is attached to one leg 213 from each pair of legs and the outer surface 268 of the second of the pair of panels is attached to the other leg from each pair of legs. The panels 262 are located proximal to the center space between the two pairs of legs 212, 214 and between the top shelf 234 and supporting and connecting members 225, 226 at the lower end of the cart. From a side view of the cart as seen in FIG. 12, the panels 262 are aligned directly behind each leg 213 and are not visible when viewed from the side. As shown in FIGS. 11A and 11B, brackets 272 are attached to a decorative disk 274 on an outer side of each pair of leg assemblies, with each disk 274 being diametrically opposed from the other.

Figure 11C:
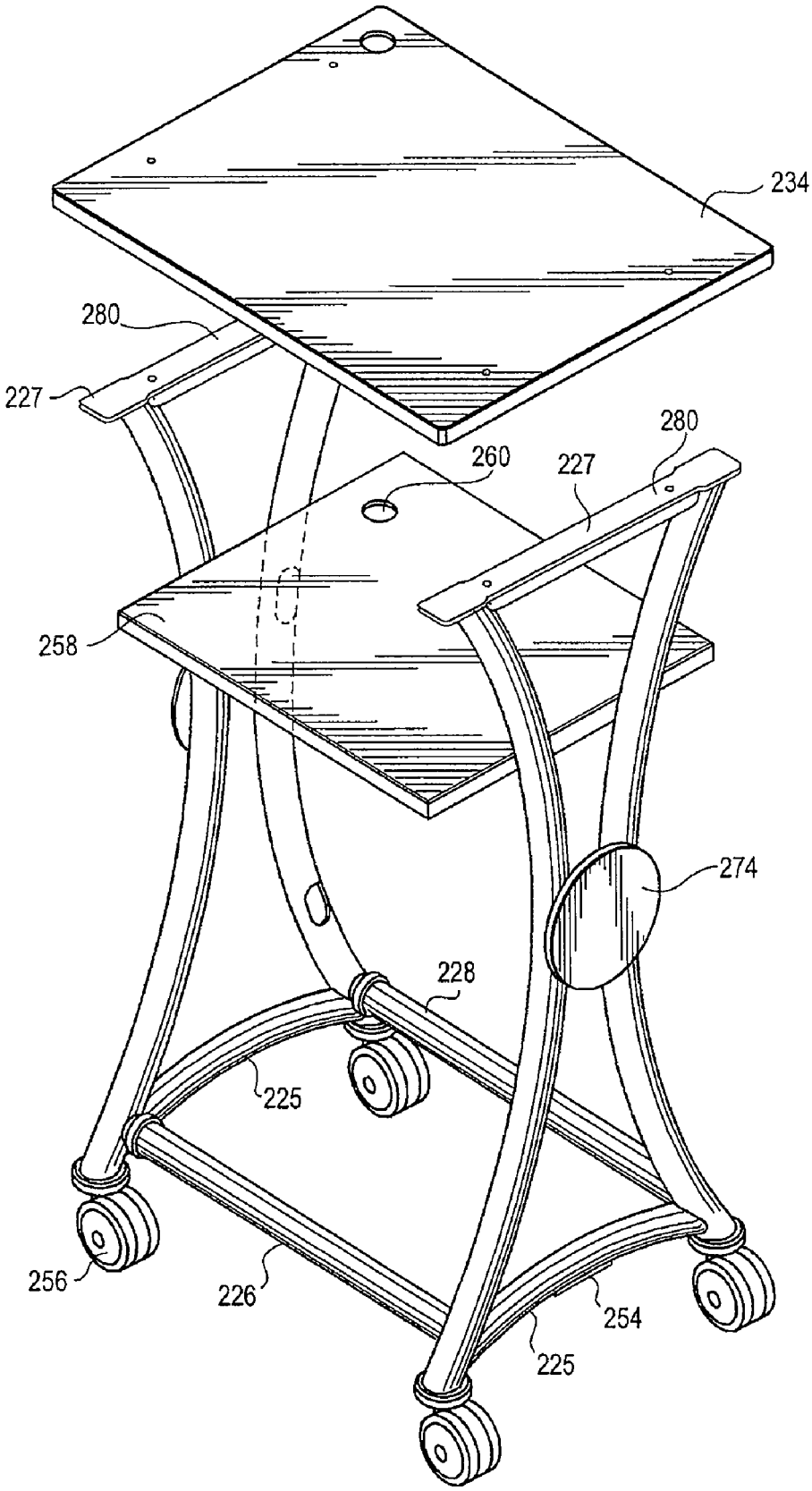
FIG. 11C is a partial exploded perspective assembly view of the cart of FIG. 11, showing an aperture in the middle shelf.

The cart 210 of the present invention further provides a construction that enables the cart to be shipped as a flat disassembled product and assembled with ease at the venue of the user, similar to that described for the first and second embodiments. As shown in FIGS. 11A, 11B, and 21, cap screws or fasteners 99 connect the connecting members 226, 228 to an extension 278 located at the bottom end 218 of each leg 213 as previously described for the first embodiment. The fasteners 99 allow the connecting members 226, 228 to be disassembled from the pairs of leg assemblies 212, 214 such that the leg assemblies may be shipped in a flat configuration. In FIG. 11C, the shelf 234 is further removable from its support upon the leg assemblies 212, 214 as shown at 280. After removal, the shelf 234 can be laid flat along the separate leg assemblies for shipment. Middle shelf 258 may equally be removed from bracket 216 for shipment in the flat configuration.

In operation, the cart 210 as shown in the illustrated embodiments can be shipped in a flat or other convenient packaging. When a user sets up the cart 210 as shown in FIG. 11 with the desired audio visual, electronic or other equipment, such as a television set, monitor, VCR, CD or DVD player or the like supported on the shelves 234, 258, electrical wires, cables or other equipment are inserted through the aperture 238 and/or 260 in the respective shelves and down through the channel in hollow leg 213 to conceal such wires while using the cart. For equipment located on the top shelf 234, the user snakes the wires through the aperture 238 located in the top shelf 234. For equipment located on the middle shelf 258, the user snakes the wire or cable through the aperture 260 located in the middle shelf 258. The wires or cable are pulled through lower aperture 263 and out of the channel in hollow leg 213. If a user needs to move or transport the cart, the caster wheel assemblies 257 will provide easy movement of the cart and the rubber coating on the wheels 256 will reduce noise and provide an even rotational surface.

In another embodiment of the cart 10 (FIG. 16), the hollow legs 13, 113, 213 of the cart are adapted to contain a material, such as polyurethane foam or the like, to minimize or dampen noise and vibration through the legs of the cart. The material may be heat activated such that the material is installed during manufacture of the cart, and expands when a surface coating is baked on the legs of the cart. The material may be in the form of blocks, such as circular, rectangular, or the like, located in specified locations throughout the legs 13, 113, 213 of the cart 10. In the leg providing the channel for guiding wires, the dampening material will have a hollow center to maintain the channel in that leg.

The foregoing description of illustrated embodiments of the invention has been presented for purposes of description, and is not intended to be exhaustive or to limit the invention to the precise forms disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

What is claimed is:

1. A cart for securing and transporting audiovisual equipment comprising:

at least two pairs of leg assemblies, each leg assembly parallel to and facing each other and each leg assembly comprising a pair of legs;

each pair of legs comprising individual legs secured to one another;

each leg having a bottom end, a top end, an outer wall, and at least one of said legs having a hollow channel extending through at least one hollow leg;

at least two connecting members extending between and removably engaging each pair of legs at the bottom end of each leg, the connecting members extending perpendicular to the plane of each pair of legs;

the at least one hollow leg also having at least one aperture extending through the outer wall of the leg, the aperture communicating with the hollow channel; and a top shelf removably mounted on the legs at the top end of the legs, the shelf having an at least one aperture near a corner of the shelf, the aperture in the shelf communicating with the channel in the at least one hollow leg.

2. The cart of claim 1 wherein the at least two pairs of leg assemblies further comprise at least two pairs of wheels, each wheel further including a caster assembly, the caster assembly facilitating rotational movement of the wheels and distributing the load evenly between each caster, the caster assembly engaging the bottom end of each leg.

3. The cart of claim 2 wherein the caster assembly for each wheel includes an isolator compressed between two metal plates, one metal plate connected to the bottom of a respective leg and the second metal plate connected to an upper portion of the caster assembly.

4. The cart of claim 1 further including a bottom shelf mounted adjacent the bottom end of each leg, and a middle shelf mounted between the top shelf and the bottom shelf, at least one aperture extending through the middle shelf, the at least one aperture in the middle shelf communicating with the channel in the at least one hollow leg.

5. The cart of claim 4 wherein a pair of panels extend vertically downward beneath the middle shelf, the panels having a ledge, an inner surface, and an outer surface, the panels and the middle shelf each removably attached to a bracket connecting each pair of legs.

6. The cart of claim 4, wherein the at least one aperture in the middle shelf is located adjacent an additional aperture in the at least one hollow leg, the additional aperture communicating with the channel in the at least one hollow leg.

7. The cart of claim 1 wherein the top shelf further includes at least one hook accessory mounting structure on an outer edge of the top shelf.

8. The cart of claim 1 wherein a first support member at the bottom end of each leg has a generally concave tubular shape and a second support member at the top end of each leg has a generally flat shape.

9. The cart of claim 1 wherein the at least one aperture in the at least one hollow leg is adapted to receive a security cable securing audiovisual equipment to the cart.

10. A cart for securing and transporting audiovisual equipment comprising:

at least two pairs of leg assemblies, each leg assembly parallel to and facing the other and each leg assembly comprising a pair of legs;

each pair of legs comprising individual legs secured to one another;

each leg having a bottom end, a top end, and an outer wall;

at least two connecting members extending between and removably engaging each pair of legs at the bottom end of each leg, the connecting members extending perpendicular to the plane of each pair of legs;

a top shelf removably mounted on the legs at the top end of the legs;

a utility shelf comprising a first portion and second portion, the first and second portion each having a substantially vertical component and a substantially horizontal component, each portion of the utility shelf pivotally connected to a connecting member on opposing legs at the bottom end of the legs, each portion further including a first open position and a second closed position, the vertical component of each portion extending parallel to each adjacent leg in the closed position of the shelf, the horizontal components communicating with each other in the closed position and resting on a lower bracket to provide a flat storage space.

11. The cart of claim 10 wherein the at least two pairs of leg assemblies further comprise at least two pairs of wheels, each wheel further including a caster assembly to facilitate the rotational movement of the wheels and to evenly distribute the load between each caster, the caster assembly engaging the bottom end of each leg.

12. The cart of claim 10 further including a middle shelf mounted between the top shelf and the utility shelf.

13. The cart of claim 12 wherein a pair of panels extend vertically downward beneath the middle shelf, the panels having a ledge, an inner surface, and an outer surface, the panels and the middle shelf each removably attached to a bracket connecting each pair of legs.

14. The cart of claim 10 wherein the top shelf further includes at least one accessory mounting hook structure on an outer edge of the top shelf.

15. The cart of claim 10 wherein a first support member at the bottom end of each leg has a generally concave tubular shape and a second support member at the top end of each leg has a generally flat shape.

16. A cart for securing and transporting audiovisual equipment comprising:

at least two pairs of leg assemblies, each leg assembly parallel to and facing each other and each leg assembly comprising a pair of legs;

each pair of legs comprising individual legs secured to one another;

each leg having a bottom end, a top end, an outer wall, at least one of said legs having a hollow channel extending through at least one hollow leg;

at least two connecting members extending between and removably engaging each pair of legs at the bottom end of each leg, the connecting members extending perpendicular to the plane of each pair of legs;

the at least one hollow leg also having at least one aperture extending through the outer wall of the leg, the aperture communicating with the hollow channel;

a top shelf removably mounted on the legs at the top end of the legs, the top shelf having at least one aperture near a corner of the shelf, the aperture in the shelf communicating with the channel in the at least one hollow leg;

a utility shelf comprising a first portion and second portion, the first and second portion each having a substantially vertical component and a substantially horizontal component, each portion of the utility shelf pivotally connected to a connecting member on opposing legs at the bottom end of the legs, each portion further including a first open position and a second closed position, the vertical component of each portion parallel extending parallel to each adjacent leg in the second closed position of the utility shelf, the horizontal components communicating with each other in the closed position and resting on a lower bracket to provide a flat storage space.

17. The cart of claim 16 further including a middle shelf mounted between the top shelf and the utility shelf, the middle shelf having at least one aperture extending through the shelf and communicating with the channel in the at least one hollow leg.

18. The cart of claim 17 wherein a pair of panels extend vertically downward beneath the middle shelf, the panels having a ledge, an inner surface, and an outer surface, the panels and the middle shelf each removably attached to a bracket connecting each pair of legs.

19. The cart of claim 16 wherein the top shelf further includes at least one accessory mounting hook structure on an outer edge of the top shelf.

20. The cart of claim 16 wherein a first support member at the bottom end of each leg has a generally concave tubular shape and a second support member at the top end of each leg has a generally flat shape.

* * * * *